US010661940B2

(12) United States Patent
Hajek

(10) Patent No.: US 10,661,940 B2
(45) Date of Patent: May 26, 2020

(54) CARTON WITH AT LEAST ONE HOLDER

(71) Applicant: Graphic Packaging International, LLC, Atlanta, GA (US)

(72) Inventor: Ronald E. Hajek, Joliet, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/113,247

(22) Filed: Aug. 27, 2018

(65) Prior Publication Data

US 2019/0071210 A1 Mar. 7, 2019

Related U.S. Application Data

(60) Provisional application No. 62/554,760, filed on Sep. 6, 2017.

(51) Int. Cl.

| | |
|---|---|
| ***B65D 5/00*** | (2006.01) |
| ***B65D 5/48*** | (2006.01) |
| ***B65D 5/66*** | (2006.01) |
| ***B31B 50/00*** | (2017.01) |
| ***B31B 50/73*** | (2017.01) |
| ***B65D 5/50*** | (2006.01) |

(52) U.S. Cl.

CPC ..... *B65D 5/0085* (2013.01); *B31B 50/0044* (2017.08); *B31B 50/734* (2017.08); *B65D 5/48016* (2013.01); *B65D 5/5021* (2013.01); *B65D 5/667* (2013.01); *B65D 5/6652* (2013.01); *B65D 5/6658* (2013.01)

(58) Field of Classification Search

CPC ..... B65D 5/0085; B65D 5/48016; B65D 5/5021; B65D 5/6652; B65D 5/6658; B65D 5/667; B65D 5/2057; B65D 5/48002; B31B 50/0044; B31B 50/734

USPC ..... 229/120.17, 114, 906, 904, 146, 148, 229/120.08, 120.18, 902, 120.13, 127, 229/149, 931, 125.27, 125.29; 206/562, 206/763, 521.6, 541

See application file for complete search history.

(56) References Cited

U.S. PATENT DOCUMENTS 662,969 A 12/1900 Roth
978,569 A 12/1910 Elkin
(Continued)

FOREIGN PATENT DOCUMENTS

CA 2 586 472 5/2006
DE 75 23 198 11/1975
(Continued)

OTHER PUBLICATIONS

International Search Report and Written Opinion for PCT/US2018/048084 dated Dec. 14, 2018.
(Continued)

*Primary Examiner* — Christopher R Demeree
(74) *Attorney, Agent, or Firm* — Womble Bond Dickinson (US) LLP

(57) ABSTRACT

A carton for holding at least one article includes a base, a lid, and a shoulder attached to the base. The base includes a first plurality of panels and the lid includes a second plurality of panels. The lid is foldably connected to the base such that the base and the lid at least partially surround an interior of the carton. The shoulder includes at least one holder for holding at least one accessory for the at least one article.

44 Claims, 10 Drawing Sheets

(56) References Cited

U.S. PATENT DOCUMENTS 1,048,577 A 12/1912 Pardoe
1,516,090 A 11/1924 Gary et al.
1,651,848 A 12/1927 Stevens
1,667,376 A 4/1928 Fehrenkamp
1,814,561 A 7/1931 Krumm
1,824,862 A 9/1931 Young
2,054,596 A 9/1936 Ford
2,091,126 A 8/1937 Speer
2,100,888 A 11/1937 Vine
2,107,946 A 2/1938 Inman
2,132,966 A 11/1938 O'Brien
2,180,808 A 11/1939 Jacobstein et al.
2,194,220 A 3/1940 Elder
2,312,595 A 3/1943 Smith
2,337,654 A 12/1943 Goodyear
2,345,000 A 3/1944 Newsom
2,363,861 A 11/1944 Goodyear
2,565,146 A 8/1951 Okon
2,583,915 A 1/1952 Whitley
2,804,252 A 8/1957 Nute
2,844,294 A 7/1958 Williams
2,852,177 A 9/1958 Frasch
2,862,612 A 12/1958 Brown
2,877,736 A 3/1959 Simmons
2,924,371 A 2/1960 Frankenstein
2,955,733 A 10/1960 Wilson
2,967,610 A 1/1961 Ebert
3,071,882 A 1/1963 Eisman et al.
3,099,381 A 7/1963 Meyers
3,107,039 A 10/1963 Painter
3,142,430 A 7/1964 Meyers
3,146,933 A 9/1964 Moore
3,204,814 A 9/1965 Mahon
3,205,603 A 9/1965 Brumley
3,240,419 A 3/1966 Spiering et al.
3,324,998 A 6/1967 Farquhar
3,352,053 A * 11/1967 Anderson ..... A01M 25/004 229/120.08
3,515,331 A 6/1970 Guthrie
3,637,130 A 1/1972 Farquhar
3,809,310 A 5/1974 VanderLugt, Jr.
3,876,131 A 4/1975 Tolaas
3,907,195 A 9/1975 Struble
3,958,744 A 5/1976 Herglotz
4,004,691 A 1/1977 Wihksne
4,008,849 A 2/1977 Baber
4,039,120 A 8/1977 Herzog
4,076,168 A 2/1978 Ferri
4,088,262 A 5/1978 Kuehlhorn
4,105,155 A 8/1978 Forbes, Jr.
4,228,945 A 10/1980 Wysocki
4,313,542 A 2/1982 Roberts et al.
4,431,128 A * 2/1984 Dirico ..... B65D 5/48002 229/120.03
4,472,896 A 9/1984 Brauner et al.
4,477,014 A 10/1984 Brandenburger
4,492,333 A 1/1985 Roberts
4,530,459 A 7/1985 Maroszek
4,592,914 A 6/1986 Kuchenbecker
4,630,733 A 12/1986 Fear
4,684,023 A 8/1987 Cortopassi
4,694,987 A * 9/1987 Forbes, Jr. ..... B65D 5/48002 229/114
4,714,190 A 12/1987 Morrocco
4,775,771 A 10/1988 Pawlowski et al.
4,798,323 A 1/1989 Platt
4,804,137 A 2/1989 Harby
4,815,609 A 3/1989 Kiedaisch
4,865,921 A 9/1989 Hollenberg et al.
4,890,439 A 1/1990 Smart
4,901,457 A 2/1990 Chandler
4,919,785 A 4/1990 Willey et al.
4,936,935 A 6/1990 Beckett
4,944,451 A 7/1990 Forbes, Jr.
4,963,424 A 10/1990 Beckett
4,993,625 A 2/1991 Stease et al.
5,034,234 A 7/1991 Andreas et al.
5,039,364 A 8/1991 Beckett et al.
5,047,710 A 9/1991 Mahoney
D320,743 S 10/1991 Alexander et al.
5,058,803 A 10/1991 Gulliver
5,071,062 A 12/1991 Bradley et al.
5,078,273 A 1/1992 Kuchenbecker
5,093,364 A 3/1992 Richards
5,096,723 A 3/1992 Turpin
5,117,078 A 5/1992 Beckett
RE33,979 E 6/1992 Cortopassi
5,118,033 A 6/1992 Kula
5,175,404 A 12/1992 Andreas et al.
5,213,902 A 5/1993 Beckett
5,221,419 A 6/1993 Beckett
5,260,537 A 11/1993 Beckett
5,266,386 A 11/1993 Beckett
5,266,763 A 11/1993 Colombo
D342,446 S 12/1993 Parker et al.
5,300,748 A 4/1994 Colombo
D346,552 S 5/1994 Krupa
RE34,683 E 8/1994 Maynard et al.
5,338,921 A 8/1994 Maheux et al.
5,340,436 A 8/1994 Beckett
5,354,973 A 10/1994 Beckett
5,358,176 A 10/1994 Rigby
5,402,931 A 4/1995 Gulliver et al.
5,410,135 A 4/1995 Pollart et al.
5,424,517 A 6/1995 Habeger, Jr. et al.
5,458,283 A 10/1995 Southwell et al.
D365,272 S 12/1995 Krupa et al.
5,484,100 A 1/1996 Rigby
5,503,324 A 4/1996 Bacchetti et al.
5,510,132 A 4/1996 Gallo, Jr.
5,519,195 A 5/1996 Keefer et al.
5,520,324 A 5/1996 Cai
5,542,536 A 8/1996 Sutherland
5,575,420 A * 11/1996 Whitnell ..... B65D 5/48002 229/104
5,582,345 A 12/1996 Lankhuijzen
5,585,027 A 12/1996 Young
5,628,921 A 5/1997 Beckett
5,662,265 A 9/1997 Jensen
5,672,407 A 9/1997 Beckett
5,688,427 A 11/1997 Gallo, Jr.
5,690,273 A 11/1997 Jensen
5,697,549 A 12/1997 Yocum
5,704,483 A 1/1998 Groh
5,707,004 A 1/1998 Cai
5,726,426 A 3/1998 Davis et al.
5,735,454 A 4/1998 Jensen
5,759,422 A 6/1998 Schmelzer et al.
5,800,724 A 9/1998 Habeger et al.
5,826,781 A 10/1998 Jensen
5,890,648 A 4/1999 Cai
5,938,110 A 8/1999 Bernstein
6,027,018 A 2/2000 Yocum
6,041,997 A 3/2000 Jensen
6,063,415 A 5/2000 Walters
6,068,181 A 5/2000 Cai
6,102,568 A 8/2000 Davis
6,114,679 A 9/2000 Lai
6,150,646 A 11/2000 Lai et al.
6,204,492 B1 3/2001 Zeng et al.
6,213,389 B1 * 4/2001 Cai ..... B65D 5/08 229/120.08
6,251,451 B1 6/2001 Zeng
6,283,364 B1 9/2001 Gray, Sr.
D458,127 S 6/2002 de Groote
D460,691 S 7/2002 Morris et al.
6,414,290 B1 7/2002 Cole et al.
6,433,322 B2 8/2002 Zeng et al.
6,440,050 B1 8/2002 Capparelli
6,455,827 B2 9/2002 Zeng
D467,499 S 12/2002 Garza et al.
D473,787 S 4/2003 Jones, Jr. et al.
6,552,315 B2 4/2003 Zeng et al.
6,568,586 B1 5/2003 VanEsley

(56) References Cited

U.S. PATENT DOCUMENTS

| | | | | |
|---|---|---|---|---|
| D484,043 | S | 12/2003 | Hwang et al. | |
| 6,677,563 | B2 | 1/2004 | Lai | |
| 6,681,983 | B2 | 1/2004 | Bill-Moore | |
| 6,683,289 | B2 | 1/2004 | Whitmore et al. | |
| 6,695,202 | B2 | 2/2004 | Miess | |
| 6,717,121 | B2 | 4/2004 | Zeng et al. | |
| 6,744,028 | B2 | 6/2004 | Chisholm et al. | |
| 6,765,182 | B2 | 7/2004 | Cole et al. | |
| 6,851,603 | B1 * | 2/2005 | Carlson | B65D 5/4295 206/562 |
| 6,866,189 | B2 | 3/2005 | Nelson | |
| 6,966,483 | B2 | 11/2005 | Manninen | |
| 7,004,314 | B2 * | 2/2006 | Pucillo | B65D 5/2057 206/217 |
| 7,019,271 | B2 | 3/2006 | Wnek et al. | |
| D532,690 | S | 11/2006 | Oliveira | |
| 7,159,760 | B2 | 1/2007 | Pluck et al. | |
| 7,323,699 | B2 | 1/2008 | Hopkins et al. | |
| 7,365,292 | B2 | 4/2008 | Cole et al. | |
| 7,414,230 | B2 | 8/2008 | Fitzwater | |
| 7,473,875 | B2 | 1/2009 | Fitzwater | |
| 7,514,659 | B2 | 4/2009 | Lafferty | |
| 7,617,969 | B2 | 11/2009 | Oliveira | |
| 7,621,439 | B2 | 11/2009 | McClure | |
| 7,652,233 | B2 | 1/2010 | Keefe | |
| 7,667,167 | B2 | 2/2010 | Fitzwater | |
| D622,139 | S | 8/2010 | Marcott | |
| D631,743 | S | 2/2011 | Hubbard, Jr. | |
| 7,893,389 | B2 | 2/2011 | Fitzwater | |
| 7,938,267 | B2 | 5/2011 | Cross | |
| 7,980,454 | B2 * | 7/2011 | Burton | B65D 5/667 229/114 |
| 7,982,167 | B2 | 7/2011 | Fitzwater | |
| 8,006,893 | B2 | 8/2011 | Burke et al. | |
| 8,056,799 | B2 | 11/2011 | Burke et al. | |
| 8,309,896 | B2 | 11/2012 | Fitzwater | |
| 8,523,049 | B2 | 9/2013 | Fitzwater | |
| D695,608 | S | 12/2013 | Pusta | |
| 8,814,033 | B2 | 8/2014 | House | |
| D752,429 | S | 3/2016 | Mayer | |
| 9,278,774 | B2 | 3/2016 | Fairchild, Jr. | |
| D753,994 | S | 4/2016 | Pantelleria | |
| 9,346,234 | B2 | 5/2016 | Hajek et al. | |
| D762,468 | S | 8/2016 | Pantelleria | |
| D769,114 | S | 10/2016 | Montemayor | |
| 9,499,296 | B2 | 11/2016 | Mills et al. | |
| 9,540,135 | B2 | 1/2017 | Robertson | |
| 2003/0047595 | A1 | 3/2003 | Bill-Moore | |
| 2003/0080120 | A1 | 5/2003 | Whitmore et al. | |
| 2003/0106926 | A1 | 6/2003 | Beatificato et al. | |
| 2003/0206997 | A1 | 11/2003 | Winkelman et al. | |
| 2004/0074953 | A1 | 4/2004 | Yocum | |
| 2004/0089656 | A1 | 5/2004 | Watkins | |
| 2004/0101605 | A1 | 5/2004 | Sigel | |
| 2004/0159698 | A1 | 8/2004 | Tallevi et al. | |
| 2005/0284865 | A1 | 12/2005 | Fogle et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0278521 | A1 | 12/2006 | Stowell | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0138247 | A1 | 6/2007 | Fitzwater | |
| 2007/0251942 | A1 | 11/2007 | Cole et al. | |
| 2007/0251943 | A1 | 11/2007 | Wnek et al. | |
| 2007/0267467 | A1 | 11/2007 | Burke et al. | |
| 2007/0267468 | A1 | 11/2007 | Burke et al. | |
| 2007/0275130 | A1 | 11/2007 | Cole et al. | |
| 2008/0000897 | A1 | 1/2008 | Robbins et al. | |
| 2008/0047958 | A1 | 2/2008 | Cole et al. | |
| 2008/0078759 | A1 | 4/2008 | Wnek et al. | |
| 2008/0081095 | A1 | 4/2008 | Cole et al. | |
| 2008/0179385 | A1 | 7/2008 | Nikolai et al. | |
| 2008/0290149 | A1 | 11/2008 | Sweet | |
| 2008/0308614 | A1 | 12/2008 | Fitzwater | |
| 2009/0039077 | A1 | 2/2009 | Fitzwater | |
| 2009/0090708 | A1 | 4/2009 | Requena et al. | |
| 2009/0140032 | A1 | 6/2009 | Cai et al. | |
| 2009/0200364 | A1 | 8/2009 | Oliveira | |
| 2010/0051675 | A1 | 3/2010 | Sweet | |
| 2010/0055260 | A1 | 3/2010 | Sweet | |
| 2010/0243510 | A1 | 9/2010 | Cross | |
| 2014/0353307 | A1 | 12/2014 | Pinkstone | |
| 2015/0136843 | A1 | 5/2015 | Bell et al. | |

FOREIGN PATENT DOCUMENTS

| | | |
|---|---|---|
| DE | 296 13 331 | 10/1996 |
| DE | 203 00 817 | 4/2003 |
| EP | 0 270 838 | 6/1988 |
| EP | 0 946 392 B1 | 6/2002 |
| EP | 1 452 458 | 9/2004 |
| EP | 1 481 922 | 12/2004 |
| FR | 2 516 481 | 5/1983 |
| FR | 2 665 882 | 2/1992 |
| FR | 2 687 384 | 8/1993 |
| FR | 2 867 346 | 9/2005 |
| GB | 2 365 000 | 2/2002 |
| JP | 4-253670 | 9/1992 |
| JP | 08-207174 | 8/1996 |
| JP | 10-101056 | 4/1998 |
| JP | 03095906 | 6/2003 |
| JP | 2004-059022 | 2/2004 |
| JP | 2004 224402 | 8/2004 |
| JP | 0 3106317 | 10/2004 |
| JP | 2005-170517 | 6/2005 |
| JP | 2007-168832 | 7/2007 |
| JP | 2012-245989 | 12/2012 |
| KR | 20-0253232 | 11/2001 |
| KR | 10-2005-0090313 | 9/2005 |
| WO | WO 91/05448 | 4/1991 |
| WO | WO 94/05563 | 3/1994 |
| WO | WO 02/40374 | 5/2002 |
| WO | WO 03/066435 | 8/2003 |
| WO | WO 2005/077783 | 8/2005 |
| WO | WO 2005/085091 | 9/2005 |
| WO | WO 2006/052326 | 5/2006 |
| WO | WO 2006/076501 | 7/2006 |
| WO | WO 2007/067705 | 6/2007 |
| WO | WO 2007/127235 | 11/2007 |
| WO | WO 2007/133659 | 11/2007 |
| WO | WO 2007/136839 | 11/2007 |
| WO | WO 2008/137525 | 11/2008 |
| WO | WO 2008/137528 | 11/2008 |
| WO | WO 2009/023286 | 2/2009 |

OTHER PUBLICATIONS

Hot Dog betaboard Box used for serving hot dog burgers and chips. [online]Published May 29, 2016. Retrieved Aug. 27, 2018 from URL: http://www.packagingbiodegradable.conn.au/honne/1033-hot-dog-clam-ec-brown-400-pcs.htnnl.

* cited by examiner

CARTON WITH AT LEAST ONE HOLDER

CROSS-REFERENCE TO RELATED APPLICATION

This application claims the benefit of U.S. Provisional Patent Application No. 62/554,760, which was filed on Sep. 6, 2017.

INCORPORATION BY REFERENCE

The disclosure of U.S. Provisional Patent Application No. 62/554,760, which was filed on Sep. 6, 2017, is hereby incorporated by reference for all purposes as if presented herein in its entirety.

BACKGROUND OF THE DISCLOSURE

The present disclosure generally relates to cartons for holding at least one article. In embodiments, the present disclosure relates to cartons that include at least one holder for holding an accessory for the at least one article.

SUMMARY OF THE DISCLOSURE

According to one aspect of the disclosure, a carton for holding at least one article comprises a base comprising a first plurality of panels and a lid comprising a second plurality of panels. The lid is foldably connected to the base such that the base and the lid at least partially surround an interior of the carton. A shoulder is attached to the base, the shoulder comprising at least one holder for holding at least one accessory for the at least one article.

According to another aspect of the disclosure, a blank for forming a carton for holding at least one article comprises a first plurality of panels for forming a base of the carton formed from the blank and a second plurality of panels for forming a lid of the carton formed from the blank. The first plurality of panels is foldably connected to the second plurality of panels such that the base and the lid at least partially surround an interior of the carton formed from the blank. The blank further comprises panels for forming a shoulder attached to the base of the carton formed from the blank. The panels for forming the shoulder comprise at least one holder for holding at least one accessory for the at least one article in the carton formed from the blank.

According to another aspect of the disclosure, a method of forming a carton for holding at least one article comprises obtaining a blank comprising a first plurality of panels, a second plurality of panels foldably connected to the first plurality of panels, and shoulder panels. The method further comprises at least partially folding the first plurality of panels to form a base of the carton, and at least partially folding the second plurality of panels to form a lid of the carton such that the base and the lid at least partially surround an interior of the carton. The method further comprises at least partially folding the shoulder panels to form a shoulder attached to the base, the shoulder comprising at least one holder for holding at least one accessory for the at least one article.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons according to the present disclosure can accommodate containers of numerous different shapes. In this specification, the terms "lower," "bottom," "upper," "top," "front," and "back" indicate orientations determined in relation to fully erected cartons. As described herein, cartons may be formed by multiple overlapping panels, end flaps, and/or other portions. Such panels, end flaps, and/or other portions may be designated in relative terms to one another, e.g., "first", "second", "third", etc., in sequential or non-sequential reference, without departing from the disclosure.

Figure 1:
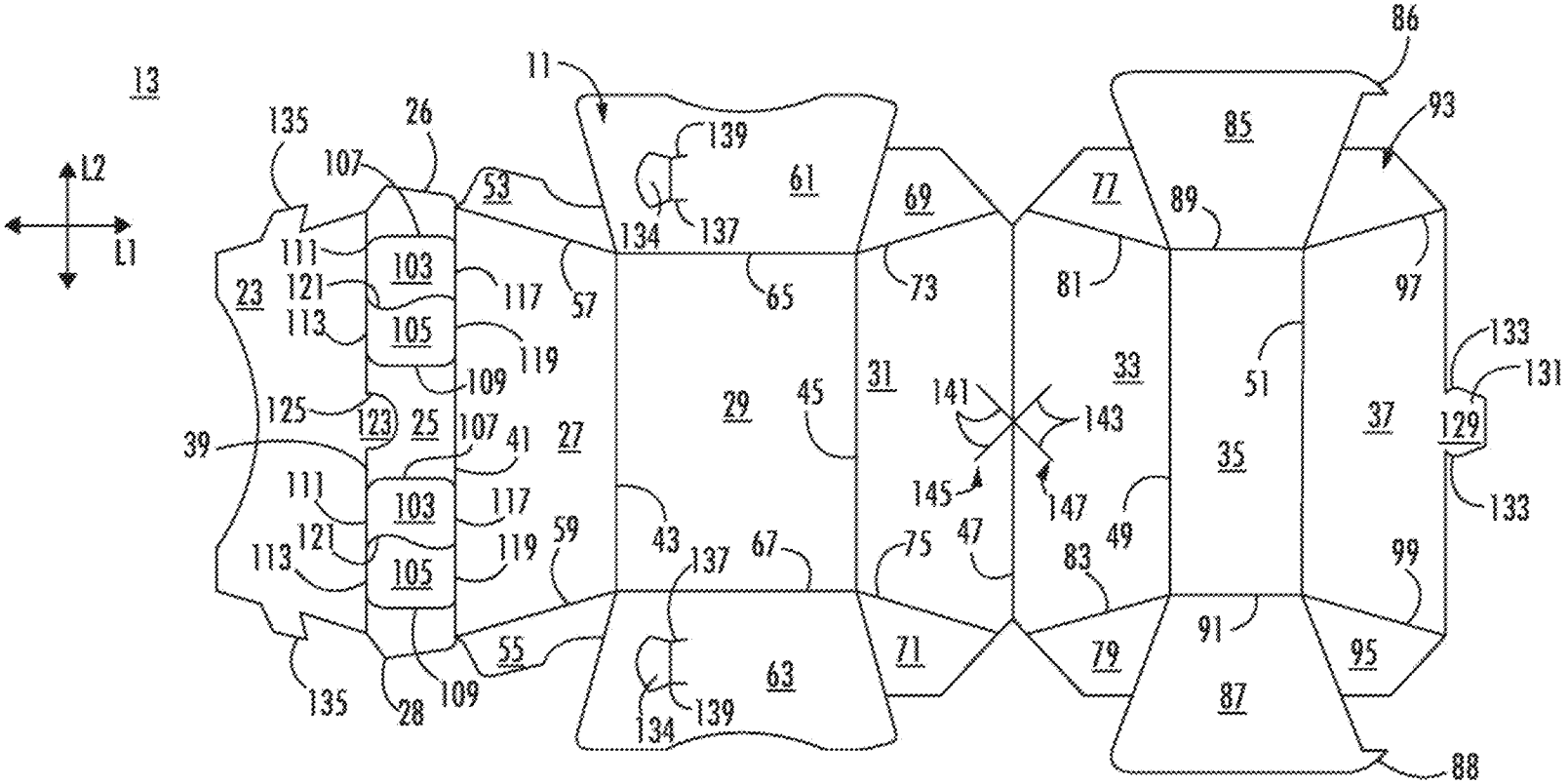
FIG. 1 is a plan view of an exterior surface of a blank for forming a carton according to a first exemplary embodiment of the disclosure.
Figure 2:
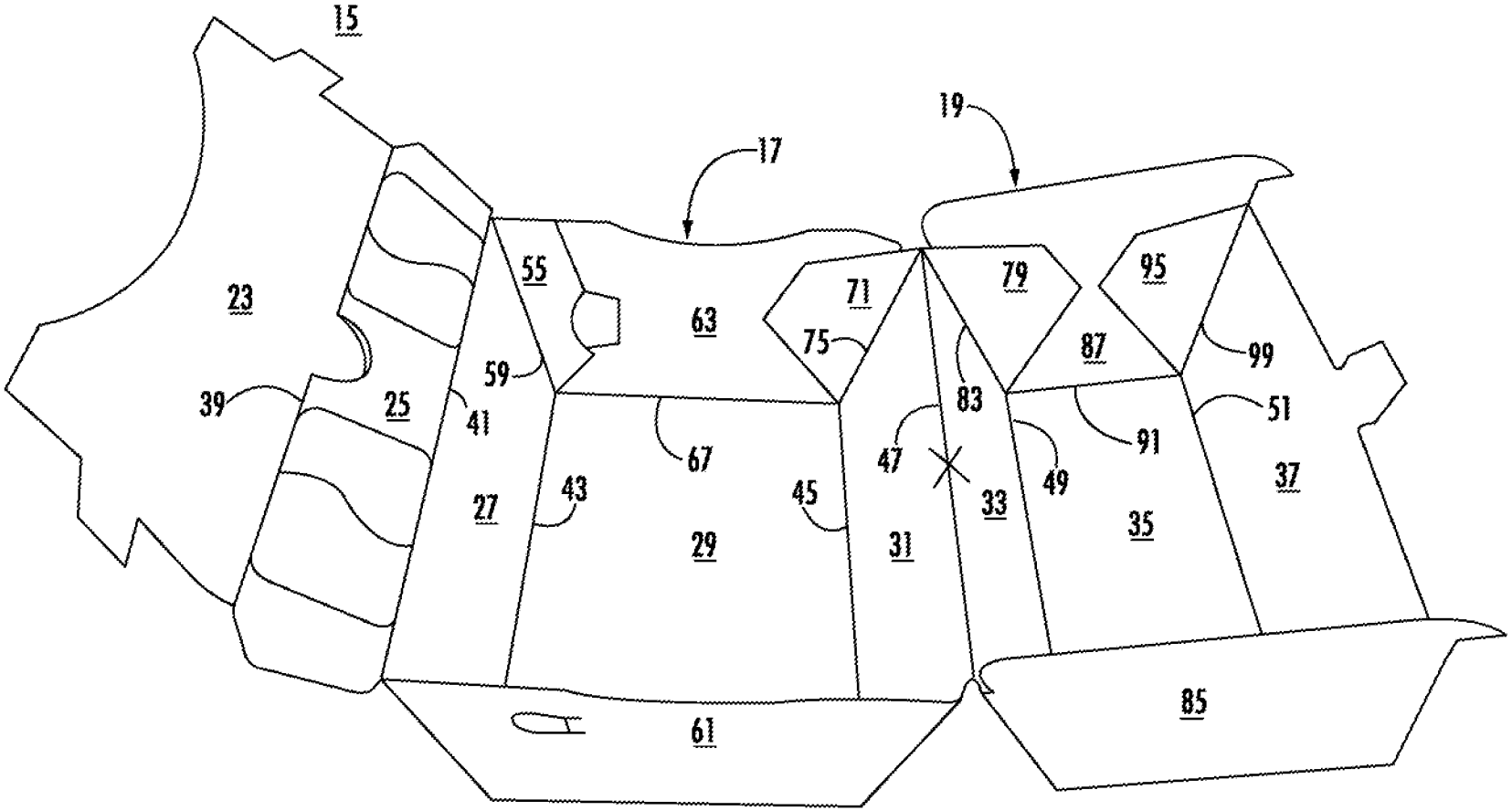
FIG. 2 is a first sequential perspective view of a partial folding of the blank of FIG. 1.
Figure 3:
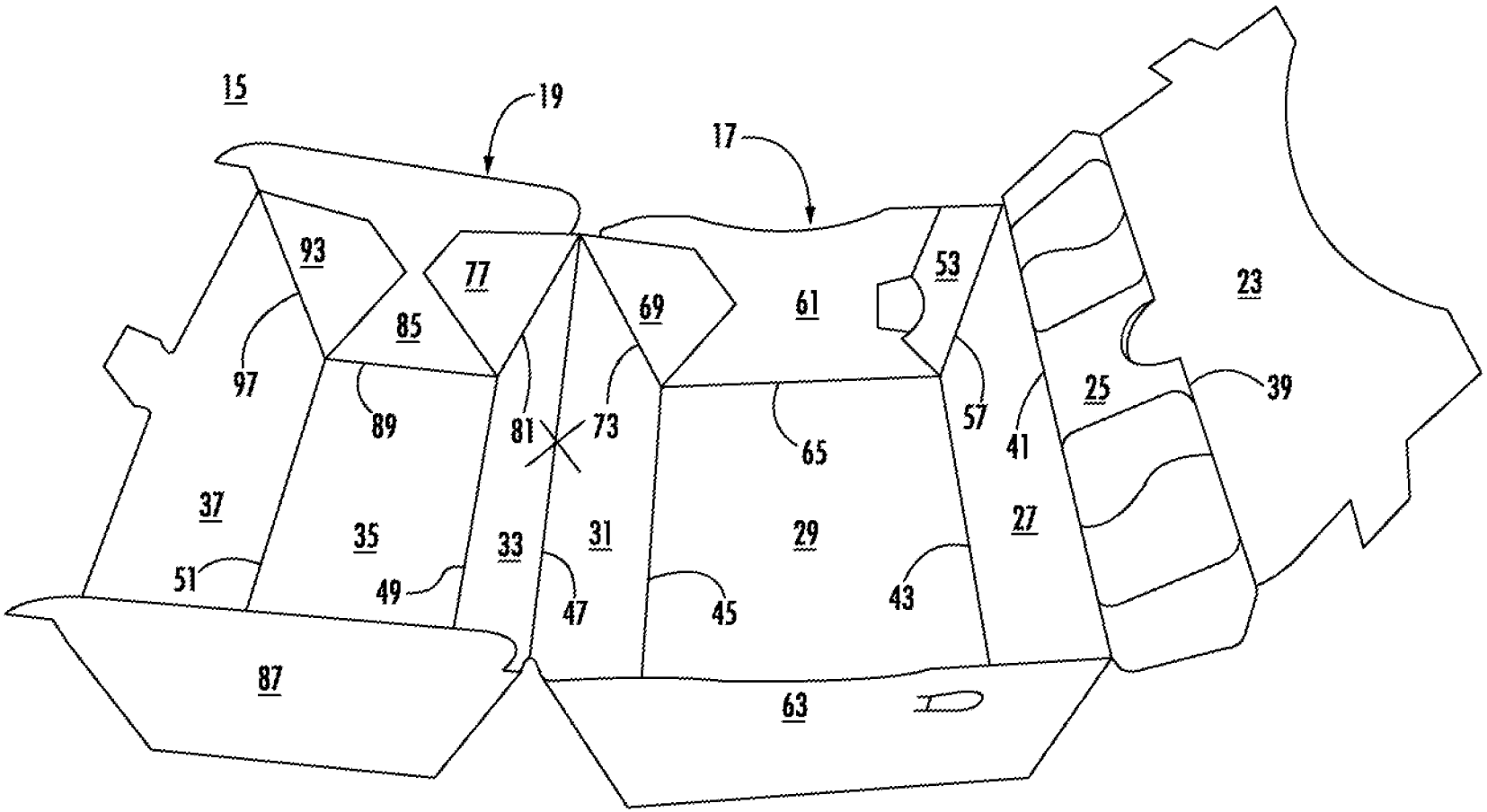
FIG. 3 is another perspective view of the partially folded blank of FIG. 2.

FIG. 1 shows an exterior surface 11 of a blank 13 for forming a carton 15 (FIG. 5) according to a first exemplary embodiment of the disclosure. As described herein, the carton 15 includes a tray or base 17 and a reclosable lid 19 foldably connected to the base 17 such that the base 17 and the lid 19 at least partially surround an interior 149 of the carton 15. Such an arrangement can be commonly referred to as a "clamshell" carton. The illustrated carton 15 can be useful for holding one or more articles such as food products F (FIG. 5) that may be provided in discrete portions, for example, chicken nuggets, chicken strips, French fries, chips, and/or other food items that can commonly be referred to as finger foods. Other types of articles that can include food products and/or nonfood products can be placed in the carton 15 for service to a customer without departing from the disclosure. Such products can be contained in additional packaging and then placed in the carton 15. As described further herein, the carton 15 includes a shoulder 20 attached to the base 17 and defining at least one holder 21 (FIG. 7) within which an accessory for one or more food products F can be held, for example, a container C for a condiment, for example, a sauce or dressing (e.g., ketchup, mustard, barbeque sauce, etc.) and/or another condiment. The carton 15 could be otherwise shaped and arranged and could be used to hold other products and/or articles in similar or different environments without departing from the disclosure.

As shown in FIG. 1, the blank 13 has a longitudinal axis L1 extending generally in the direction of the length of the blank 13 and a lateral axis L2 extending generally in the direction of the width of the blank 13. In one embodiment, the blank 13 comprises a front extension flap 23, a front extension panel 25, a front panel 27, a bottom panel 29, a first back panel 31, a second back panel 33, and a top panel 35, and a lid panel 37. As illustrated, the front extension flap 23 is foldably connected to the front extension panel 25 at a lateral fold line 39, the front extension panel 25 is foldably connected to the front panel 27 at a lateral fold line 41, the front panel 27 is foldably connected to the bottom panel 29 at a lateral fold line 43, the bottom panel 29 is foldably connected to the first back panel 31 at a lateral fold line 45, the first back panel 31 is foldably connected to the second back panel 33 at a lateral fold line 47, the second back panel 33 is foldably connected to the top panel 35 at a lateral fold line 49, and the top panel 35 is foldably connected to the lid panel 37 at a lateral fold line 51. In one embodiment, the first back panel 31, the bottom panel 29, and the front panel 27 can be a first plurality of panels at least partially forming the base 17 of the carton 15, the second back panel 33, the top panel 35, the lid panel 37 can be a second plurality of panels foldably connected to the first plurality of panels and for at least partially forming the lid 19 of the carton 15, and a portion of the bottom panel 29, the front panel 27, the front extension panel 25, and the front extension flap 23 can be shoulder panels that at least partially form the shoulder 20 of the carton 15.

In the illustrated embodiment, a first end flap 53 and a second end flap 55 are foldably connected to the front panel 27 at respective oblique fold lines 57, 59, a first end flap 61 and a second end flap 63 are foldably connected to the bottom panel 29 at respective longitudinal fold lines 65, 67, a first end flap 69 and a second end flap 71 are foldably connected to the first back panel 31 at respective oblique fold lines 73, 75, a first end flap 77 and a second end flap 79 are foldably connected to the second back panel 33 at respective oblique fold lines 81, 83, a first end flap 85 and a second end flap 87 are foldably connected to the top panel 35 at respective longitudinal fold lines 89, 91, and a first end flap 93 and a second end flap 95 are foldably connected to the lid panel 37 at respective oblique fold lines 97, 99. As shown, the end flaps 53, 61, 69, 77, 85, 93 extend along a first marginal area of the blank 13 and the end flaps 55, 63, 71, 79, 87, 95 extend along a second marginal area of the blank 13. As described herein, when the carton 15 (FIG. 5) is erected, the end flaps 53, 61, 69, 77, 85, 93 at least partially close a first lateral side 16 (FIG. 6) of the carton 15, and the end flaps 55, 63, 71, 79, 78, 95 at least partially close a second lateral side 18 of the carton 15. Different flap arrangements can be used for closing the sides of the carton 15 without departing from the disclosure.

Still referring to FIG. 1, two pairs of retention flaps 103, 105 are foldably connected to the front extension panel 25 at respective fold lines 107, 109. The retention flaps 103, 105 are at least partially defined by respective cuts 111, 113 and 117, 119 in the front extension panel 25 that interrupt the respective lateral fold lines 39, 41, and are separated by a respective cut 121 that may have an at least partially curved, e.g., wave-shaped or sinusoidal, configuration. As described herein, the retention flaps 103, 105 can be deflected away (e.g., downwardly) from the front extension panel 25 to form holders 21 (FIG. 7) in the carton 15, for example, to receive one or more accessories, such as the container C, for the one or more food products F.

As shown, the blank 13 comprises locking features which includes a tab 123 protruding from the front extension flap 23 into a portion of the front extension panel 25 adjacent a cut 125 extending between portions of the lateral fold line 39. In one embodiment, the cut 125 is curved or semi-circular, but the cut 125 and the tab 123 could be otherwise shaped, arranged, and/or configured without departing from the disclosure. As described further herein, the tab 123 can be deflected away from the front extension panel 25 upon formation of the carton 15 to provide an opening 127 (FIG. 5) for receiving a lock 129 extending from a free edge of the lid panel 37 to maintain closure of the carton 15. As shown, the lock 129 includes a head 131 defined by a pair of notches 133 adjacent the free edge of the lid panel 37. The head 131 can have a trapezoidal profile, as shown, or in embodiments, may have a different configuration, for example, square or rectangular, triangular, pentagonal, heptagonal, or octagonal, or any other suitable shape. The locking features may also include extensions 86, 88 protruding from the respective end flaps 85, 87 and respective ledges 26, 28 defined at lateral end portions of the front extension panel 25. The extensions 86, 88 can engage the respective ledges 26, 28 upon closure of the carton 15, as described further herein. The locking features can have a different configuration without departing from the disclosure.

As also shown in FIG. 1, the blank 13 comprises interengaging features to effect formation of the carton 15 (FIG. 5) that include openings 134 in the respective end flaps 61, 63 that receive tabs 135 extending from respective lateral edge portions of the front extension flap 23. A pair of cuts 137, 139, as shown, can extend from each opening 134 into the respective end flaps 61, 63 to provide relief portions that are activable, for example, during formation, use, and/or other manipulation of the carton 15.

In the illustrated embodiment of FIG. 1, the first back panel 31 comprises cuts 141 and second back panel 33 comprises cuts 143. As shown, the cuts 141, 143 intersect to form an X-shaped configuration and define relief portions 145, 147 in the back panels 31, 33. The relief portions 145, 147 can, for example, minimize, inhibit, and/or prevent the back panels 31, 33 from buckling when the carton 15 is opened, closed, or otherwise manipulated. The relief portions 145, 147 could be otherwise shaped, arranged, configured, and/or omitted without departing from the scope of the disclosure.

Referring additionally to FIGS. 2-5, in one exemplary embodiment of forming the blank 13 into the carton 15, the base 17 of the carton 15 can be formed by folding the front panel 27 upwardly relative to the bottom panel 29 at the fold line 43, folding the first back panel 31 upwardly relative to the bottom panel 29 at the fold line 45, and folding the end flaps 53, 61, 69, 59, 63, 71 upwardly at respective fold lines 57, 65, 73, 59, 67, 75, as shown. The base 17 can be arranged such that the end flaps 53, 69 are in at least partial face-to-face contact with the end flap 61 and the end flaps 55, 71 are in at least partial face-to-face contact with the end flap 63. As described herein, the flaps 53, 69 and the flaps 55, 71 can be positioned on an external surface or an internal surface of the respective end flaps 61, 63.

As shown, the lid 19 of the carton 15 can be formed by folding the second back panel 33 upwardly relative to the top panel 35 at the fold line 49, folding the lid panel 37 upwardly relative to the top panel 35 at the fold line 51, and folding the end flaps 77, 85, 93, 83, 87, 95 upwardly at respective fold lines 81, 89, 97, 83, 91, 99, as shown. The lid 19 can be arranged such that the end flaps 77, 93 are in at least partial face-to-face contact with the end flap 85 and the end flaps 79, 95 are in at least partial face-to-face contact with the end flap 87. As described herein, the flaps 77, 93 and the flaps 79, 95 can be positioned on an external surface or an internal surface of the respective end flaps 85, 87.

Figure 4:
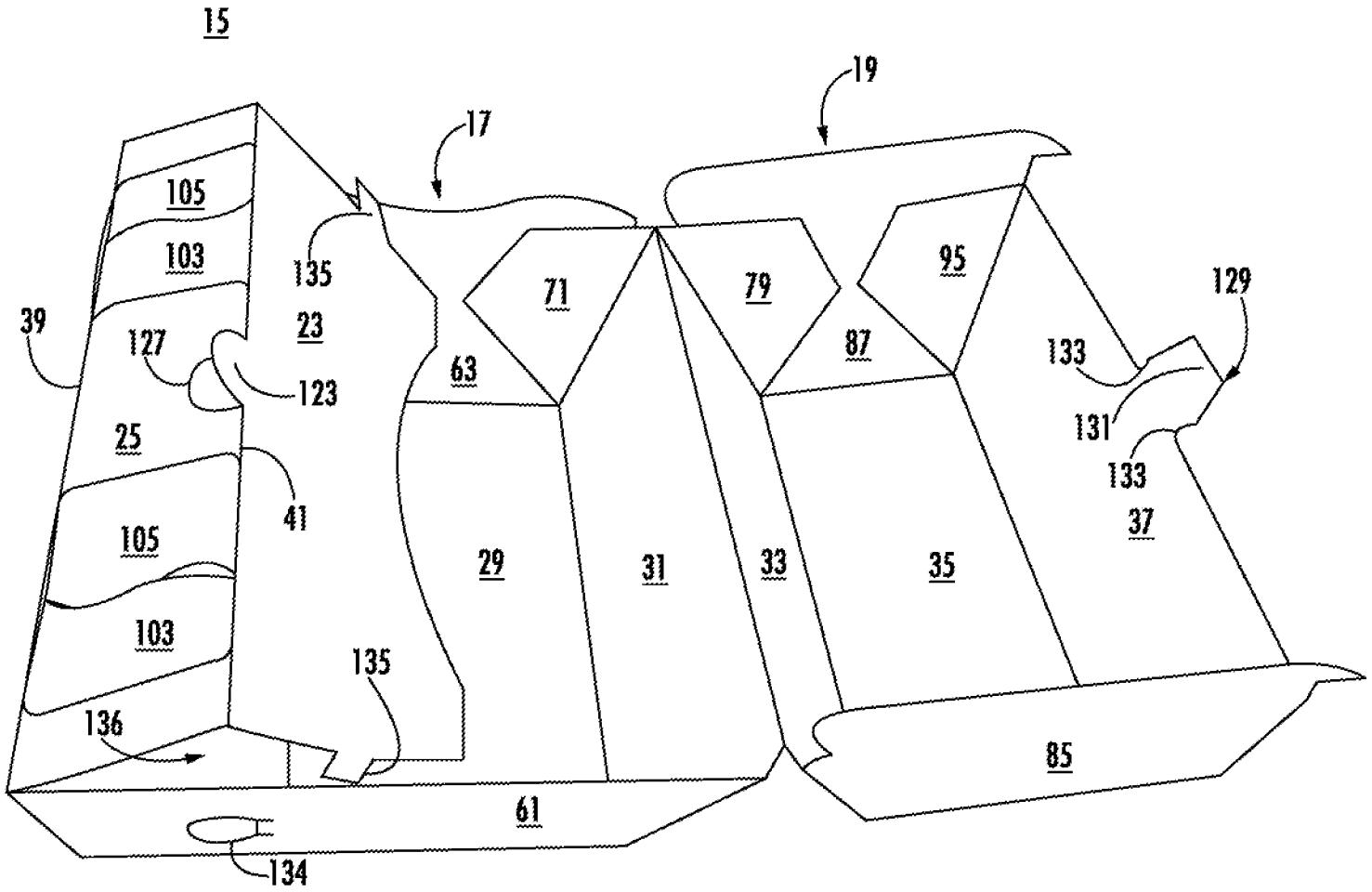
FIG. 4 is a second sequential perspective view of a partial folding of the blank of FIG. 1.
Figure 5:
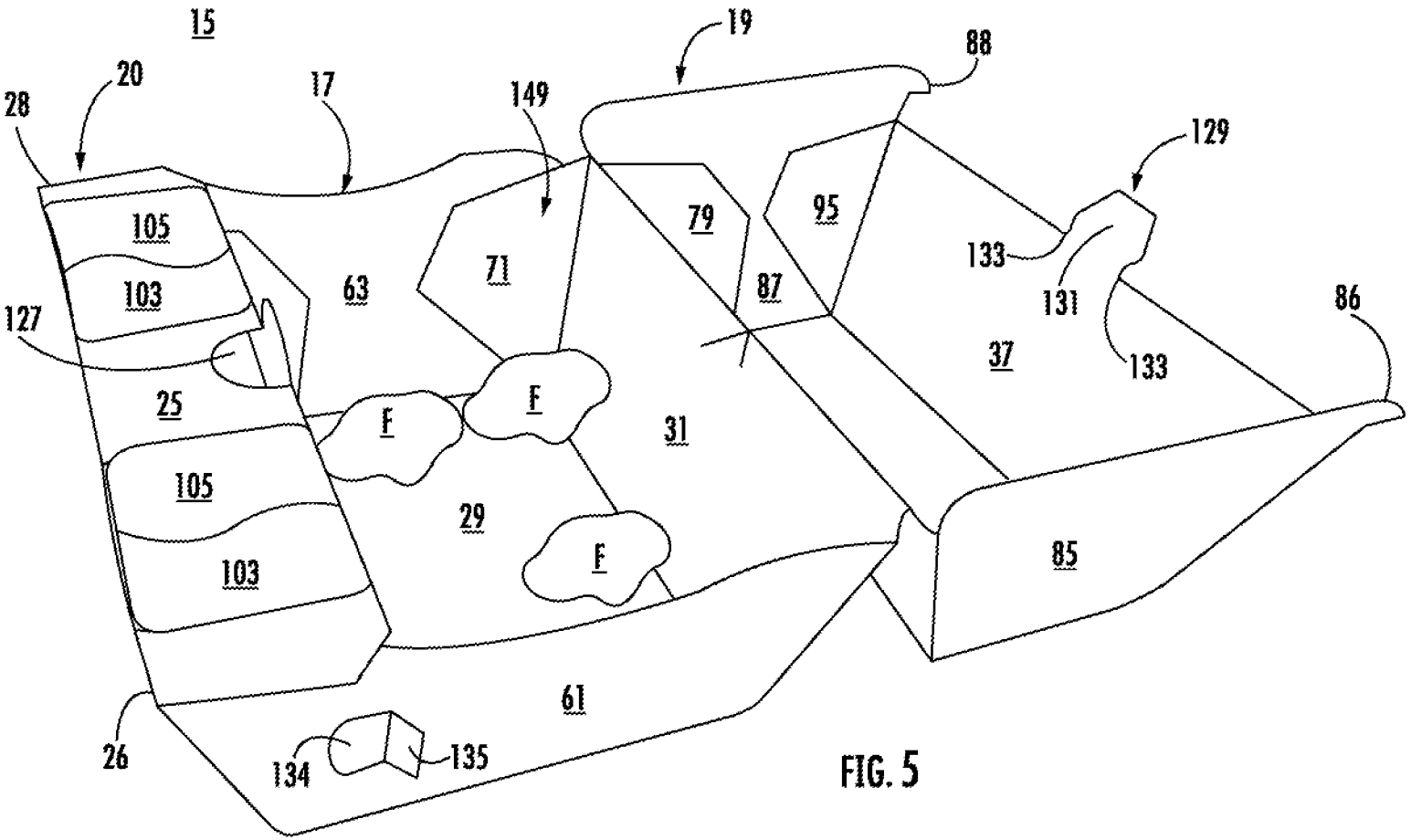
FIG. 5 is a perspective view of a carton formed from the blank of FIG. 1 and in an open configuration according to the first exemplary embodiment of the disclosure.

As shown in FIGS. 4 and 5, the shoulder 20 can be formed by folding the front extension panel 25 at the fold line 41 into substantially parallel planar relation with the bottom panel 29 and folding the front extension flap 23 at the fold line 39 downwardly toward the bottom panel 29 and into general parallel relation with the front panel 27. The tabs 135 of the front extension flap 23 can then be inserted through the openings 134 in the respective end flaps 61, 63 such that and an interior chamber 136 is formed in the shoulder 20 and such that the above-described configuration of the shoulder 20 is maintained. The above-described arrangement of overlapping portions of the blank 13 to form the carton 15 can be maintained through the use of an adhesive such as glue.

Still referring to FIGS. 1 and 5, the carton 15 is shown in an open configuration in which the lid 19 is foldably attached to but otherwise disengaged from the base 17 such that an interior 149 of the carton 15 is accessible. In such a configuration of the carton 15, one or more food products F can be placed in the interior 149, for example, for transport, storage, and/or serving.

Figure 6:
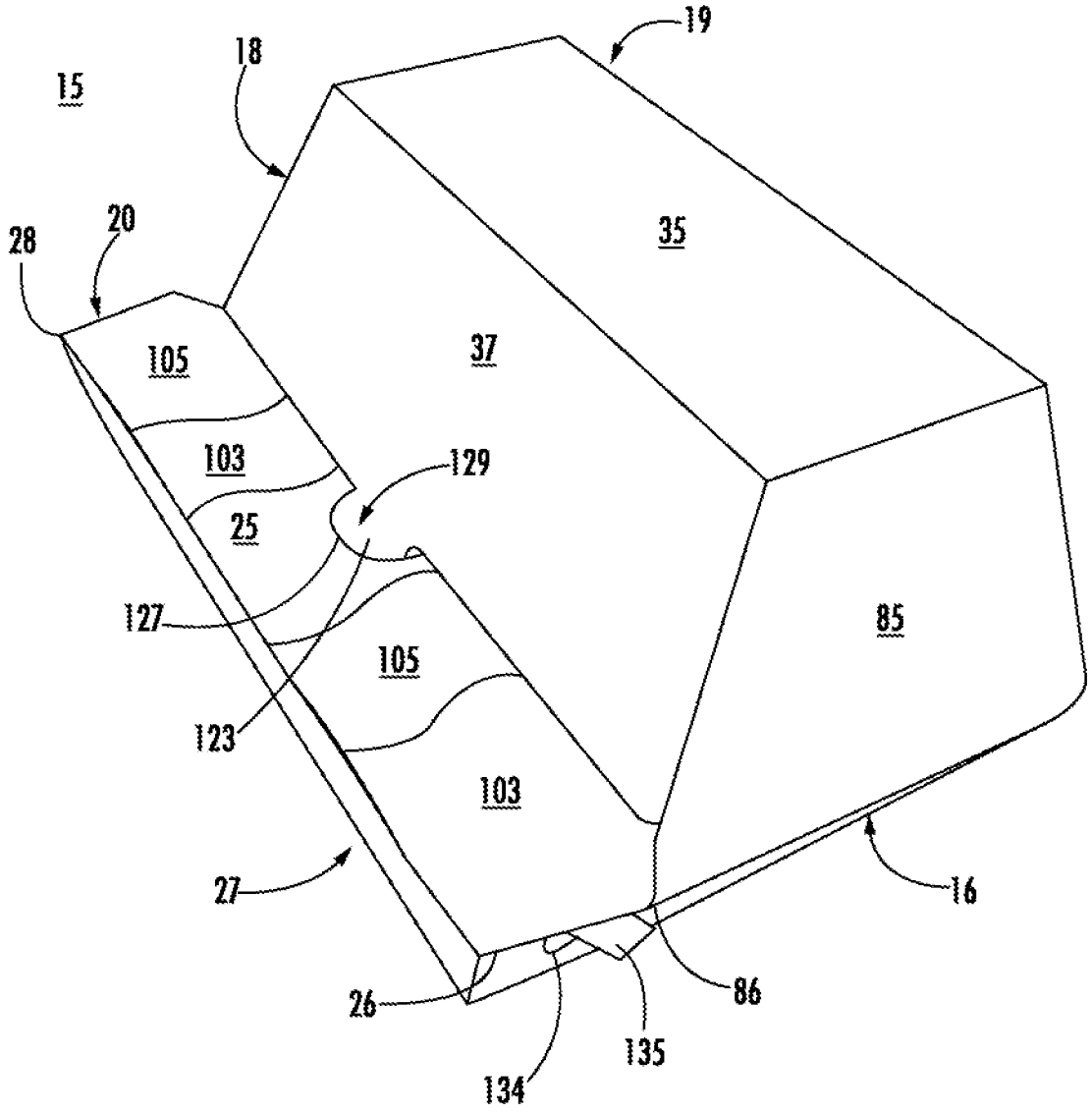
FIG. 6 is another perspective view of the carton of FIG. 5 in a closed configuration.

Referring additionally to FIG. 6, in order to close the carton 15, the lid 19 can be folded at the fold line 47 toward the base 17, which may include at least partial camming or deflection of the extensions 86, 88 about the respective ledges 26, 28. Upon alignment of the lid 19 with the base 17, the lock 129 enters the opening 127 such that the carton 15 is maintained in the above-described closed configuration. In particular, the notches 133 of the lock 129 can become disposed between the head 131 and the front extension panel 25 adjacent the opening 127 to maintain closure of the carton 15. As also shown, the disposition of the extensions 86, 88 disposed beneath the respective ledges 26, 28 can assist in inhibiting or preventing opening of the carton 15 absent purposeful manipulation by a user.

Figure 7:
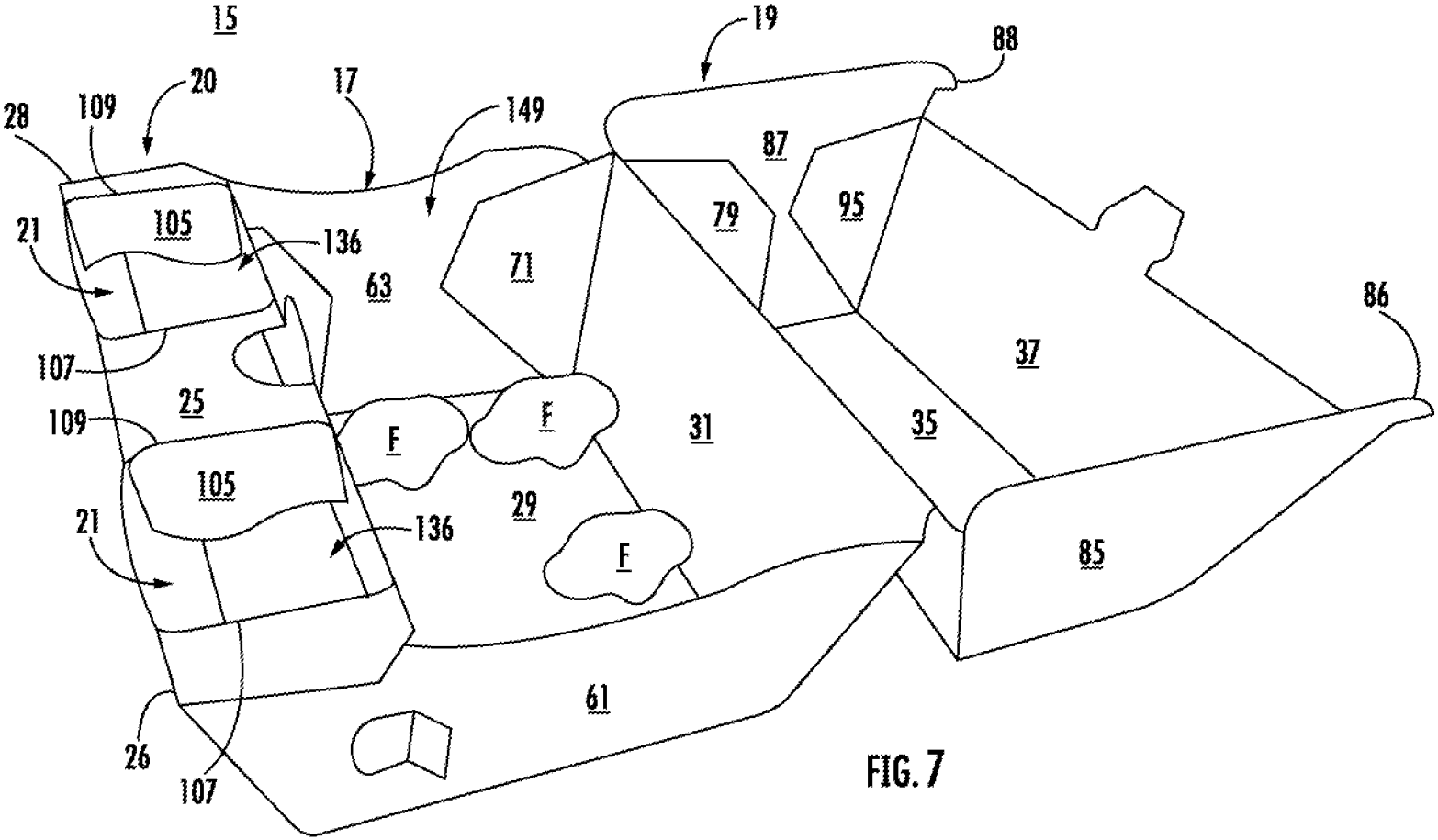
FIG. 7 is a perspective view of the carton of FIG. 5 in the open configuration and having a pair of holders formed therein.
Figure 8:
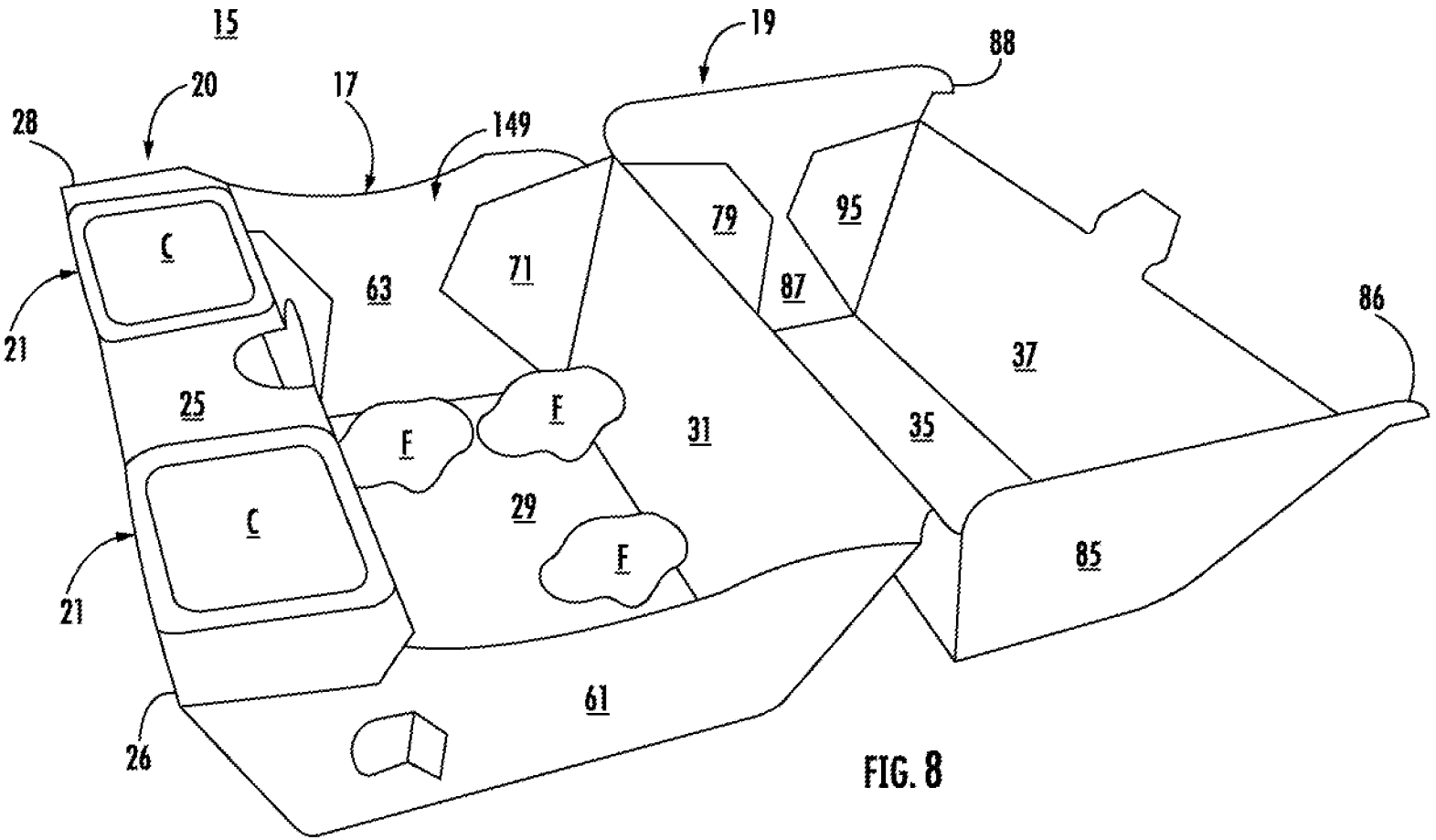
FIG. 8 is a perspective view of the carton of FIG. 7 in the open configuration and having accessories disposed in the holders.

Referring to FIGS. 1, 7, and 8, when received by a user, the carton 15 can be opened by a customer by disengaging the lock 129 from the opening 127 and raising the lid 19 away from the base 17, which may include camming or deflecting the extensions 86, 88 about the respective ledges 26, 28. In the open configuration, one or more food products F can be retrieved by a user from the interior 149 of the carton 15. In the course of using the carton 15, it may be desired to position one or more accessories for one or more of the food products F nearby. Accordingly, a user can fold one or more of the pairs of retention flaps 103, 105 downwardly relative to the front extension panel 25 at respective fold lines 107, 109 into the interior chamber 136 such that one or more holders 21 that are at least partially defined by the shoulder 20 and that extend into the interior chamber 136 are accessible. As described herein, the holders 21 can include the retention flaps 103, 105, and can additionally include portions of the interior chamber 136. As shown, the carton 15 includes a first holder 21 and a second holder 21, though a different number of holders can be provided without departing from the disclosure. The holders 21 provide convenient locations for one or more accessories for the one or more food products F, for example, a container C. As shown, the containers C can be partially recessed within the respective holders 21 such that the containers C or other accessories are at least partially disposed in the interior chamber 136 of the shoulder 20, and edge portions of the containers C, such as flanges or rims R, can rest upon the front extension panel 25 such that the containers C are suspended above the bottom panel 29 of the carton 15 for convenient access by a customer. In addition, the retention flaps 103, 105 can be disposed adjacent and in generally parallel relation to the sides of the containers C, for example, to provide support and stability for the containers C. In this regard, a user can dip or scoop one or more of the food products F into one or more of the containers C prior to consuming or serving one or more of the food products F. Alternatively, one or both of the holders 21 can be configured as openings formed in the front extension panel 25, such that one or both of the retention flaps 103, 105 could be omitted without departing from the disclosure.

It will be understood that the carton 15 can be formed, closed, and/or opened by other alternative methods and steps without departing from the disclosure.

Figure 9:
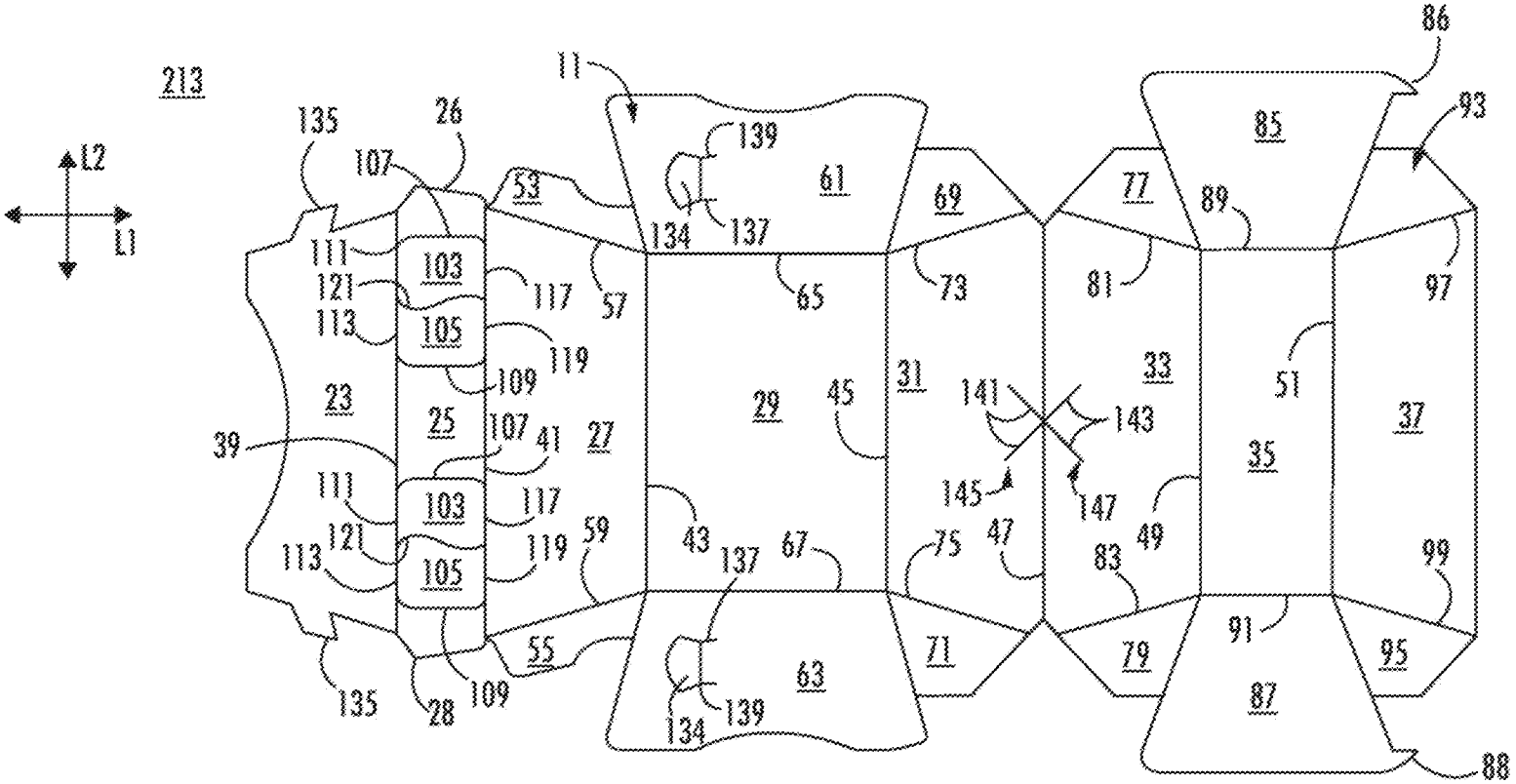
FIG. 9 is a plan view of an exterior surface of a blank for forming a carton according to a second exemplary embodiment of the disclosure.

Referring to FIG. 9, a blank 213 for forming a carton according to a third exemplary embodiment of the disclosure is illustrated. The blank 213 and the carton formed therefrom may have substantially similar features as the blank 13 and carton 15 (FIGS. 1, 6) of the first exemplary embodiment of the disclosure, but the lid panel 37 may be devoid of a lock, such as the lock 129 of the first exemplary embodiment, and the front extension flap 23 may be devoid of a tab (such as the tab 123 of the first exemplary embodiment) for forming an opening for receiving a lock. In this regard, a carton formed from the blank 213 can maintain closure of the lid 19 relative to the base 17 via engagement of the respective ledges 26, 28 with the respective extensions 86, 88, as described above.

Figure 10:
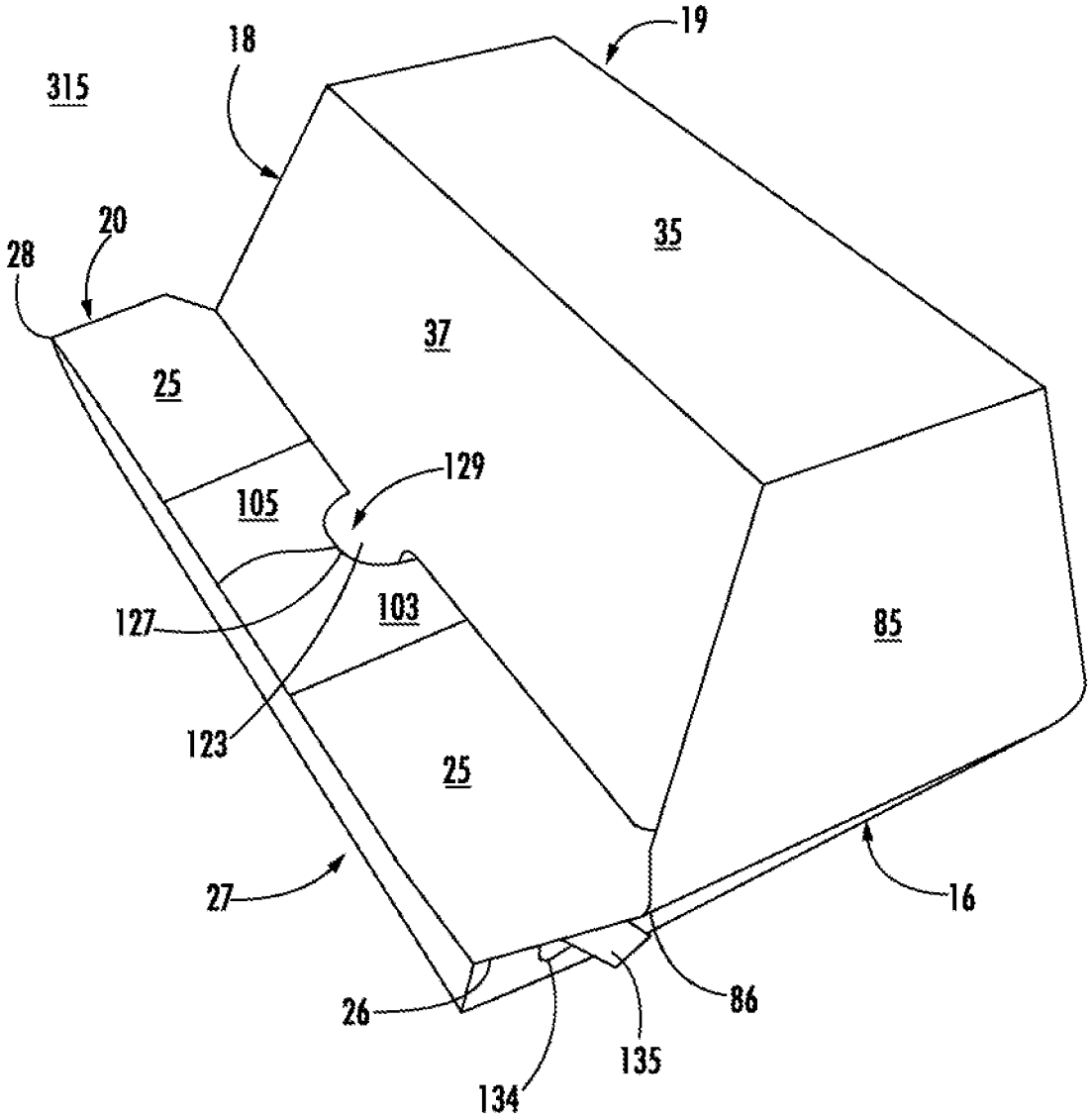
FIG. 10 is a perspective view of a carton according to a third exemplary embodiment of the disclosure.

Referring to FIG. 10, a carton 315 according to a third exemplary embodiment of the disclosure is illustrated. The carton 10 may have substantially similar features as the blank 13 and the carton 15 (FIGS. 1 and 6) of the first exemplary embodiment described herein, but may have a single central holder 21 with retention flaps 103, 105 formed in the shoulder 20. It will be understood that a different number and/or arrangement of retention flaps and holders can be provided without departing from the disclosure.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the cartons to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a base comprising a first plurality of panels, the first plurality of panels comprising a first back panel, a bottom panel, and a front panel;

a lid comprising a second plurality of panels, the second plurality of panels comprising a second back panel, a top panel, and a lid panel, the lid foldably connected to the base such that the base and the lid at least partially surround an interior of the carton;

a shoulder attached to the base and comprising a portion of the bottom panel, the front panel, a front extension panel foldably connected to the front panel, and a front extension flap foldably connected to the front extension panel at a fold line, the shoulder comprising at least one holder for holding at least one accessory for the at least one article; and locking features comprising a lock extending from the lid panel and an opening in the shoulder for at least partially receiving the lock, the opening intersects the fold line.

2. The carton of claim 1, further comprising a plurality of end flaps foldably connected to respective panels of the first plurality of panels and the second plurality of panels and forming a first lateral side of the carton and a second lateral side of the carton.

3. The carton of claim 1, wherein the shoulder at least partially defines an interior chamber, the at least one holder extends into the interior chamber.

4. The carton of claim 3, wherein the shoulder comprises at least one retention flap foldably connected to the shoulder, the at least one retention flap is folded downwardly into the interior chamber to form the at least one holder.

5. The carton of claim 4, wherein the at least one holder is a first holder, and the carton further comprises a second holder extending into the interior chamber.

6. The carton of claim 1, wherein the shoulder at least partially forms an interior chamber.

7. The carton of claim 6, wherein the front extension flap extends in general parallel relation with the front panel.

8. The carton of claim 7, further comprising a plurality of end flaps foldably connected to respective panels of the first plurality of panels and the second plurality of panels, the plurality of end flaps comprises a first end flap and a second end flap each foldably connected to the bottom panel and each comprising an opening, and wherein the front extension flap comprises a pair of tabs, each tab extending through a respective opening of the respective first end flap and the second end flap.

9. The carton of claim 6, wherein the at least one holder comprises at least one retention flap foldably connected to the front extension panel, the at least one holder extends at least partially into the interior chamber.

10. The carton of claim 9, wherein the at least one holder is a first holder, and the carton further comprises a second holder extending into the interior chamber.

11. The carton of claim 1, wherein the front extension panel comprises the opening for at least partially receiving the lock.

12. The carton of claim 11, wherein the lock comprises a head defined by a pair of notches.

13. The carton of claim 11, further comprising a plurality of end flaps foldably connected to respective panels of the first plurality of panels and the second plurality of panels, wherein at least one end flap of the plurality of end flaps comprises at least one extension for engagement with at least one ledge of the front extension panel, and wherein the locking features further comprise the at least one extension and the at least one ledge.

14. The carton of claim 13, wherein the at least one end flap is foldably connected to the top panel.

15. The carton of claim 1, wherein the lid is foldably connected to the base such that the lid is positionable to form an open configuration of the carton in which the lid is positioned away from the base and a closed configuration of the carton in which the lid at least partially encloses the base, when the carton is in the closed configuration, the front extension panel extends between the lid panel and the front panel.

16. The carton of claim 1, wherein the lid is foldably connected to the base such that the lid is positionable to form an open configuration of the carton in which the lid is positioned away from the base and a closed configuration of the carton in which the lid overlaps the base, the at least one holder is accessible in the closed configuration of the carton.

17. A blank for forming a carton for holding at least one article, the blank comprising:

a first plurality of panels for forming a base of the carton formed from the blank and comprising a first back panel, a bottom panel, and a front panel;

a second plurality of panels for forming a lid of the carton formed from the blank and comprising a second back panel, a top panel, and a lid panel, the first plurality of panels is foldably connected to the second plurality of panels such that the base and the lid at least partially surround an interior of the carton formed from the blank;

panels for forming a shoulder attached to the base of the carton formed from the blank, the panels for forming the shoulder comprising the front panel, a front extension panel foldably connected to the front panel, and a front extension flap foldably connected to the front extension panel at a fold line, the panels for forming the shoulder are for forming at least one holder for holding at least one accessory for the at least one article in the carton formed from the blank; and locking features comprising a lock extending from the lid panel and an opening in at least one panel of the panels for forming the shoulder, the opening intersects the fold line and being for at least partially receiving the lock in the carton formed from the blank.

18. The blank of claim 17, further comprising a plurality of end flaps foldably connected to respective panels of the first plurality of panels and the second plurality of panels and for forming a first lateral side of the carton formed from the blank and a second lateral side of the carton formed from the blank.

19. The blank of claim 17, wherein at least one retention flap is foldably connected to at least one panel of the panels for forming the shoulder in the carton formed from the blank.

20. The blank of claim 19, wherein the at least one holder is a first holder, and the plurality of panels for forming the shoulder further comprises a second holder.

21. The blank of claim 17, wherein the panels for forming the shoulder comprise a portion of the bottom panel, the shoulder at least partially forms an interior chamber in the carton formed from the blank.

22. The blank of claim 21, further comprising a plurality of end flaps foldably connected to respective panels of the first plurality of panels and the second plurality of panels, the plurality of end flaps comprises a first end flap and a second end flap each foldably connected to the bottom panel and each comprising an opening, and wherein the front extension flap comprises a pair of tabs for extending through a respective opening of the respective first end flap and the second end flap in the carton formed from the blank.

23. The blank of claim 21, wherein the at least one holder comprises at least one retention flap foldably connected to the front extension panel.

24. The blank of claim 23, wherein the at least one holder is a first holder, and the plurality of panels for forming the shoulder further comprises a second holder.

25. The blank of claim 17, wherein the shoulder in the carton formed from the blank comprises a portion of the bottom panel, wherein the front extension panel comprises the opening for at least partially receiving the lock in the carton formed from the blank.

26. The blank of claim 25, wherein the lock comprises a head defined by a pair of notches.

27. The blank of claim 25, further comprising a plurality of end flaps foldably connected to respective panels of the first plurality of panels and the second plurality of panels, wherein at least one end flap of the plurality of end flaps comprises at least one extension for engagement with at least one ledge of the front extension panel in the carton formed from the blank, and wherein the locking features further comprise the at least one extension and the at least one ledge.

28. The blank of claim 27, wherein the at least one end flap is foldably connected to the top panel.

29. A method of forming a carton for holding at least one article, the method comprising:

obtaining a blank, the blank comprising a first plurality of panels comprising a first back panel, a bottom panel, and a front panel, a second plurality of panels foldably connected to the first plurality of panels and comprising a second back panel, a top panel, and a lid panel, shoulder panels comprising the front panel, a front extension panel foldably connected to the front panel, and a front extension flap foldably connected to the front extension panel at a fold line, and locking features comprising a lock extending from the lid panel and an opening for receiving the lock, the opening in at least one panel of the shoulder panels and intersecting the fold line;

at least partially folding the first plurality of panels to form a base of the carton;

at least partially folding the second plurality of panels to form a lid of the carton, the base and the lid at least partially surround an interior of the carton; and at least partially folding the shoulder panels to form a shoulder attached to the base, the shoulder comprising at least one holder for holding at least one accessory for the at least one article.

30. The method of claim 29, further comprising a plurality of end flaps foldably connected to respective panels of the first plurality of panels and the second plurality of panels, and further comprising at least partially folding the plurality of end flaps to form a first lateral side of the carton and a second lateral side of the carton.

31. The method of claim 29, wherein the shoulder at least partially defines an interior chamber, the at least one holder extends into the interior chamber.

32. The method of claim 31, wherein the shoulder comprises at least one retention flap foldably connected to the shoulder, the at least one retention flap is folded downwardly into the interior chamber to form the at least one holder.

33. The method of claim 32, wherein the at least one holder is a first holder, and the carton further comprises a second holder extending into the interior chamber.

34. The method of claim 29, wherein the shoulder comprises a portion of the bottom panel, the shoulder at least partially forms an interior chamber.

35. The method of claim 34, wherein the front extension flap extending in general parallel relation with the front panel.

36. The method of claim 35, further comprising a plurality of end flaps foldably connected to respective panels of the first plurality of panels and the second plurality of panels, the plurality of end flaps comprises a first end flap and a second end flap each foldably connected to the bottom panel and each comprising an opening, and wherein the front extension flap comprises a pair of tabs, each tab extending through a respective opening of the respective first end flap and the second end flap.

37. The method of claim 34, wherein the at least one holder comprises at least one retention flap foldably connected to the front extension panel, the at least one holder extends at least partially into the interior chamber.

38. The method of claim 37, wherein the at least one holder is a first holder, and the carton further comprises a second holder extending into the interior chamber.

39. The method of claim 29, wherein the shoulder comprises a portion of the bottom panel, wherein the front extension panel comprises the opening for at least partially receiving the lock.

40. The method of claim 39, wherein the lock comprises a head defined by a pair of notches.

41. The method of claim 39, further comprising a plurality of end flaps foldably connected to respective panels of the first plurality of panels and the second plurality of panels, wherein at least one end flap of the plurality of end flaps comprises at least one extension for engagement with at least one ledge of the front extension panel, and wherein the locking features further comprise the at least one extension and the at least one ledge.

42. The method of claim 41, wherein the at least one end flap is foldably connected to the top panel.

43. The method of claim 29, wherein the lid is foldably connected to the base such that the lid is positionable to form an open configuration of the carton in which the lid is positioned away from the base and a closed configuration of the carton in which the lid at least partially encloses the base, and the method further comprises positioning the lid to form the closed configuration of the carton with the front extension panel extending between the lid panel and the front panel.

44. The method of claim 29, wherein the lid is foldably connected to the base such that the lid is positionable to form an open configuration of the carton in which the lid is positioned away from the base and a closed configuration of the carton in which the lid overlaps the base, and the method further comprises positioning the lid to form the closed configuration of the carton, the at least one holder is accessible in the closed configuration of the carton.

* * * * *